US008151490B2

(12) United States Patent
Sokolowski

(10) Patent No.: US 8,151,490 B2
(45) Date of Patent: Apr. 10, 2012

(54) DANCE SHOE

(75) Inventor: Susan L. Sokolowski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/706,763

(22) Filed: Feb. 17, 2010

(65) Prior Publication Data

US 2010/0139119 A1 Jun. 10, 2010

Related U.S. Application Data

(62) Division of application No. 11/457,221, filed on Jul. 13, 2006, now Pat. No. 7,685,740.

(51) Int. Cl.
*A43B 11/00* (2006.01)
*A43B 5/12* (2006.01)
*A43C 11/12* (2006.01)

(52) U.S. Cl. ..... 36/51; 36/50.1; 36/8.3

(58) Field of Classification Search ..... 36/51, 50.1, 36/55, 58.5, 58.6, 50.5, 8.3
See application file for complete search history.

(56) References Cited

U.S. PATENT DOCUMENTS

| | | | | |
|---|---|---|---|---|
| 88,494 A | | 3/1869 | Lowrey | |
| 832,550 A | | 10/1906 | Lepper | |
| 1,976,819 A | * | 10/1934 | Weiler | 36/166 |
| 2,068,251 A | * | 1/1937 | Ullrich | 36/170 |
| 2,088,851 A | | 8/1937 | Gantenbein | |
| 2,304,384 A | | 12/1942 | Stemmons | |
| 3,148,463 A | | 9/1964 | Tibbitts | |
| 3,243,901 A | | 4/1966 | Clarizio | |
| 4,412,393 A | | 11/1983 | Terlizzi, Jr. et al. | |
| 4,453,996 A | | 6/1984 | Terlizzi, Jr. et al. | |
| 4,616,432 A | | 10/1986 | Bunch et al. | |
| 4,766,681 A | * | 8/1988 | O'Rourke et al. | 36/89 |
| 4,776,110 A | | 10/1988 | Shiang | |
| 4,926,569 A | * | 5/1990 | Bunch | 36/91 |
| 5,319,866 A | | 6/1994 | Foley et al. | |
| 5,337,493 A | * | 8/1994 | Hill | 36/54 |

(Continued)

FOREIGN PATENT DOCUMENTS

DE 1973891 11/1967

(Continued)

OTHER PUBLICATIONS

International Search Report and Written Opinion of International Search Authority dated Feb. 15, 2008 in Application No. PCT/US2007/014451.

(Continued)

*Primary Examiner* — Ted Kavanaugh
(74) *Attorney, Agent, or Firm* — Banner & Witcoff, Ltd.

(57) ABSTRACT

An article of footwear configured for use as a dance shoe is provided. The article of footwear can include an upper and a two-piece sole connected to the upper. The article can also include a cage support that surrounds a portion of the upper and aids in flexibility of the shoe. The article can also include a single piece liner with an integrated toe box. In addition, the shoe can include an offset lacing system. In another arrangement, the shoe can include an elastic wrap, connected to the bottom of the shoe on the inside of the upper. The wrap can act as a tongue to minimize contact between the offset lacing system and the dancer's foot. In yet another arrangement, the shoe can include different types of outsole supports.

20 Claims, 19 Drawing Sheets

U.S. PATENT DOCUMENTS

| | | | | |
|---|---|---|---|---|
| 5,410,821 | A | 5/1995 | Hilgendorf | |
| 5,675,914 | A | 10/1997 | Cintron | |
| 5,682,685 | A | 11/1997 | Terlizzi | |
| 5,692,319 | A | 12/1997 | Parker et al. | |
| D388,948 | S | 1/1998 | Sessa | |
| 5,720,118 | A | 2/1998 | Mayer et al. | |
| 5,966,841 | A * | 10/1999 | Barret | 36/50.1 |
| 6,076,284 | A | 6/2000 | Terlizzi | |
| 6,237,252 | B1 * | 5/2001 | Cook | 36/50.1 |
| 6,367,169 | B1 * | 4/2002 | Barret | 36/51 |
| 6,393,733 | B1 * | 5/2002 | London et al. | 36/91 |
| 6,418,641 | B1 | 7/2002 | Schenkel | |
| 6,449,879 | B1 | 9/2002 | Fallon et al. | |
| 6,588,124 | B2 | 7/2003 | Morrone | |
| 6,817,112 | B2 | 11/2004 | Berger et al. | |
| 6,895,693 | B2 | 5/2005 | Baruck | |
| 6,915,596 | B2 | 7/2005 | Grove et al. | |
| 7,337,558 | B2 * | 3/2008 | Terlizzi et al. | 36/8.3 |
| 7,685,740 | B2 | 3/2010 | Sokolowski | |
| 2006/0137216 | A1 | 6/2006 | Ahlbaumer | |

FOREIGN PATENT DOCUMENTS

| | | |
|---|---|---|
| GB | 194547 | 3/1923 |
| WO | 2006 098811 | 9/2006 |
| WO | 20007059016 | 5/2007 |

OTHER PUBLICATIONS

International Preliminary Examination Report in Application No. PCT/US2007/014451, dated Jan. 22, 2009.

* cited by examiner

DANCE SHOE

CROSS REFERENCE TO RELATED APPLICATIONS

This non-provisional U.S. patent application is a divisional application and claims priority to U.S. patent application Ser. No. 11/457,221 which was filed in the U.S. Patent and Trademark Office on Jul. 13, 2006, and entitled Dance Shoe, pending, such prior application being entirely incorporated herein by reference.

TECHNICAL FIELD

This invention relates generally to an article of footwear. More particularly, this invention relates to a shoe that is configured to be used as a dance shoe.

BACKGROUND

Articles of footwear, in particular, athletic shoes, can be thought of as having two major components, an upper and a sole. The upper is secured to the sole and provides a cavity for receiving a foot. The upper is generally formed from multiple elements stitched or adhesively bonded together to form a structure for comfortably receiving a foot. In addition, the upper also includes a lacing system which, when loosened can allow the cavity for receiving the foot to expand to permit feet of varying sizes to fit into the cavity. The lacing system can then be secured to pull the upper in to surround the foot and secure the shoe to the foot. A tongue portion, covering the top of the foot and extending under the lacing system may also be included. The tongue may be stitched to the upper and enhances the comfort of the shoe.

The sole is the interface between the foot and the ground and is intended to provide traction, support and cushioning for the user. Many soles have a multi-part construction including an outsole and a midsole. The outsole is generally designed for durability and traction. The midsole is commonly designed to absorb the force created as the shoe contacts the ground. The sole may be flexible to cater to the intended purpose of the shoe. For example, shoes made particularly for use in dancing or dance-related activities may include a flexible sole to allow for various dance or dance-related foot movements.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Aspects of the dance shoe presented relate to an article of footwear that is configured to allow flexibility and provide support for a dancer's foot. In one configuration, the dance shoe includes an upper with an offset lacing system, and a sole, that can be two separate pieces, each attached to the upper. The dance shoe can include a liner, placed inside the upper, formed of one piece and having an integrated toe box. The liner can also include holes for breathability of the liner and a plurality of ribs, formed on the bottom of the liner, to promote flexibility of the liner. The dance shoe can also include a cage support that surrounds a portion of the upper. The cage support can include a spine to support the curve of the foot during various dance movements, and offset support tabs to add additional support.

In another arrangement, the dance shoe can include an upper having a gap formed for the offset lacing system. The lacing system can include a traditional lace strung through a plurality of apertures arranged along the sides of the gap. The lacing system can also be an elastic lace tensioned by a toggle. The shoe can also include an elastic wrap placed within the upper and connected to the bottom of the shoe. The wrap can act as a tongue to minimize contact between the lacing system and the foot.

In yet another arrangement, the dance shoe can include rear outsole supports of various types and sizes. For example, the rear outsole can be low or short to be used for traditional types of dance, such as ballet and jazz. In addition, the rear outsole can be relatively larger or taller to be used with types of dance such as tap and ballroom.

DETAILED DESCRIPTION OF THE DRAWINGS

Figure 1:
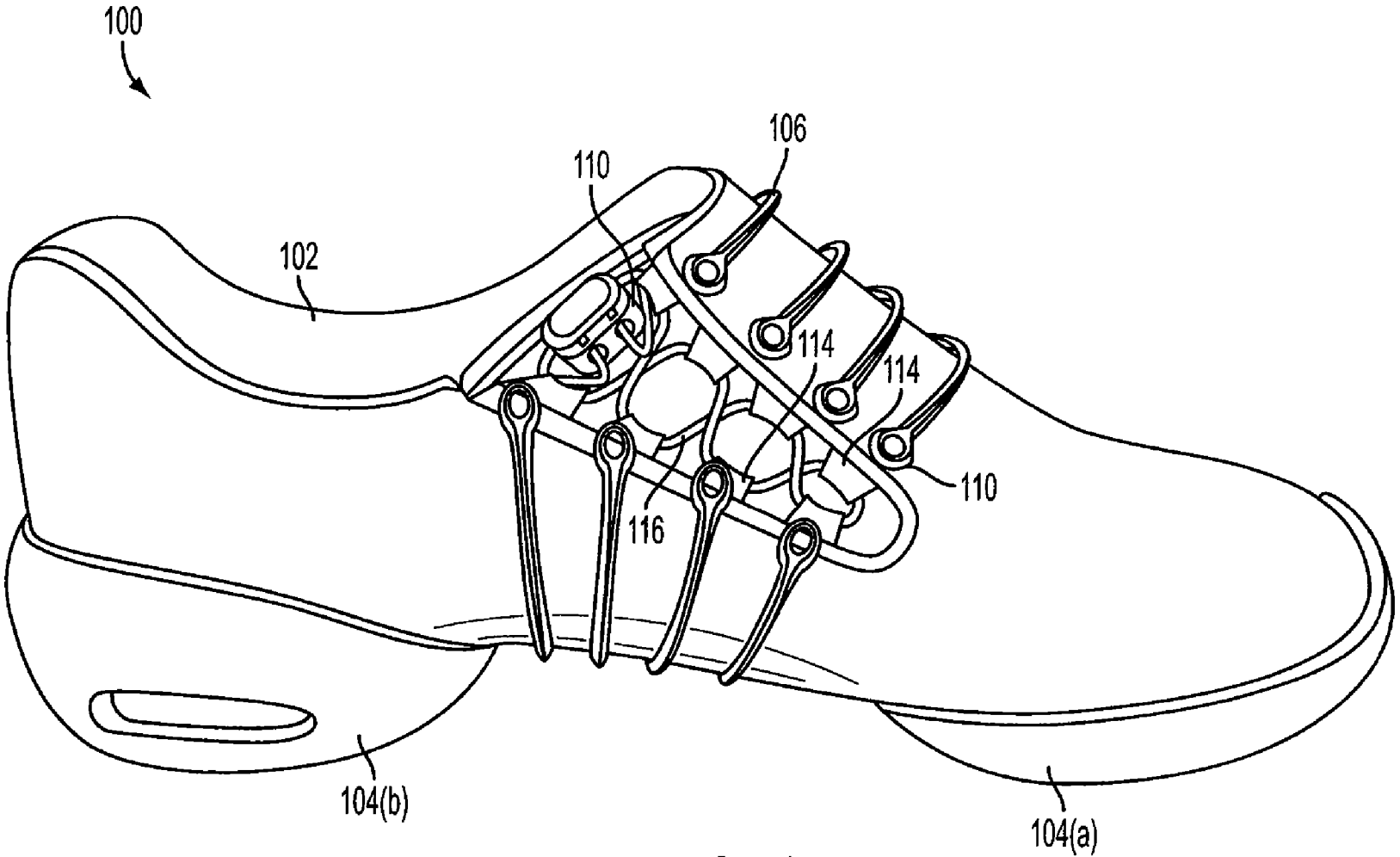
FIG. 1 is a perspective view of a dance shoe according to aspects of the present invention.

One example configuration showing aspects of the dance shoe 100 is seen in FIGS. 1-17. The shoe generally includes an upper portion 102 and a sole 104 and can include aspects such as a support cage 106 with a spine having a curved configuration, such as an s-configuration, and offset support tabs. In addition, the sole 104 of the shoe can include separated outsole supports 104(*a*), 104(*b*). The upper portion 102 of the shoe 100 can include a breathable boot with an offset lacing system 110 and a liner with an integrated toe box. The liner can have ventilation holes for breathability. In addition, the liner can have ribs located on the underside of the liner that promote flexibility of the liner. These aspects of the shoe may be practiced together or in various combinations.

FIG. 1 depicts a shoe 100 according to aspects of the present invention. As seen in FIG. 1, the shoe 100 includes an upper 102 or boot portion and a sole 104. The upper 102 can be made of a breathable material to manage heat and odor. In addition, the upper 102 may be lightweight and sleek to ensure the shoe does not detract from the dancer's overall appearance.

The upper 102 can also include an offset lacing system 110. This offset lacing system 110 can be formed in a gap in the upper 102 and can include apertures 114 through which a lace 116 may be extended. The apertures 114 may be holes, loops, slots or any other suitable device for guiding and holding a lace 116. In addition, the lace 116 may be any suitable device for securing the shoe 100 to the foot of the user. Such lacing devices can include a conventional lace that is tied, an elastic lace drawcord with a slide closure to secure the shoe to the foot, and the like.

The sole 104 of the shoe 100 can be a two-piece sole. The forward piece 104(*a*) of the sole 104 can be connected to the upper 102 beneath the toe region. This sole piece can provide support and/or traction for the dancer's foot from the ball area of the foot forward. In addition, a second sole piece 104(*b*) can be connected to the heel region of the upper 102. This piece can provide support and/or traction from the rear arch area of the foot to the heel of the foot. The two-piece sole 104(*a*), 104(*b*), or split sole, can provide greater flexibility for the shoe 100. For instance, a dancer may desire a shoe 100 having the ability to bend or flex around the midpoint of the sole of the shoe 100. A conventional, one piece sole may inhibit this flexibility. In addition, the split sole 104(*a*), 104(*b*) allows the dancer's foot to achieve the desired line between the leg and foot when flexed, to provide the overall appearance the dancer desires. The split sole 104(*a*), 104(*b*) can provide less resistance to foot bending motion, while still providing the toe and heel support the dance may need.

Figure 6:
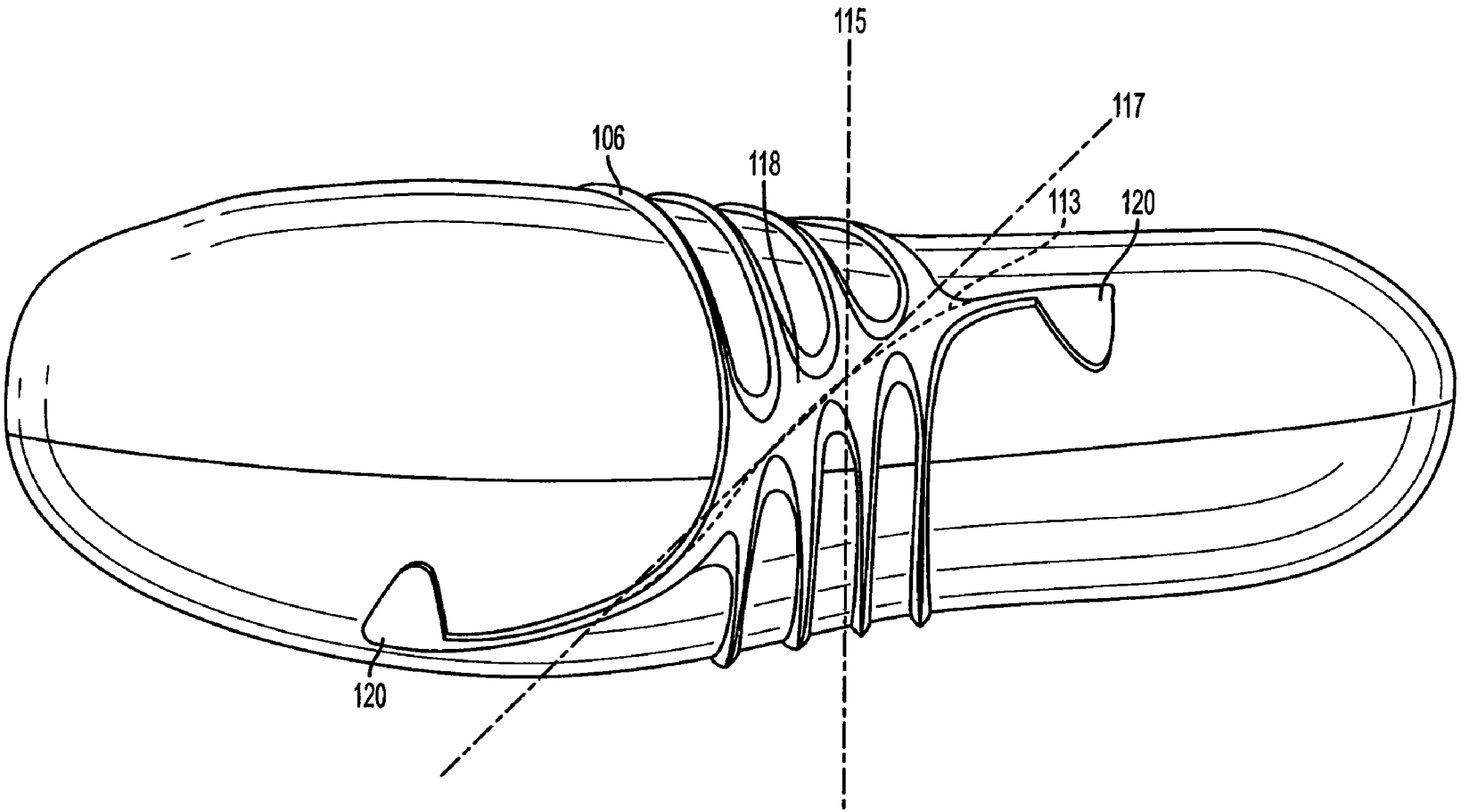
FIG. 6 is a bottom view of the dance shoe of FIG. 1 with the support cage shown but without the separated outsole supports.

Further to FIG. 1, the shoe 100 can include a cage support 106 surrounding a portion of the upper 102. The cage support 106 can include a spine (118 in FIG. 6) positioned beneath the arch area of the user's foot and extending between the toe area and the heel area. As seen in FIG. 6, the cage 106 can also include offset support tabs 120. The tabs 120, along with the spine 118 of the cage 106, allow flexibility of the shoe 100 in a desired direction, while resisting flex in other directions. For instance, dancers stand en pointe during various dance movements. When doing so, the foot flexes by curling around the arch portion. The cage support 106 allows curling flexibility while resisting improper twisting of the foot when curled. Thus, it encourages curling of the foot in line with the length of the foot along a pivot line (115 in FIG. 6) transverse to the foot, and it discourages twisting along a diagonal pivot line (117 in FIG. 6). The cage 106 provides support during dance moves involving such flexed positions.

In addition, the cage support 106 of FIG. 1 also aids in maintaining the desired line formed by the dancer's leg and foot in certain positions. For instance, as a dancer stands en pointe, the leg and foot form a distinct line that can be a measure of a dancer's ability. The cage support 106 will aid in forming and maintaining this line by flexing in the desired direction and resisting improper twisting of the foot.

The cage support 106 may be formed of any suitable material, such as plastic. In addition, the cage support 106 can be removably attached to the upper 102 to aid in donning and doffing the shoe, or to remove the cage support 106 as desired. The cage support 106 can be connected at points on either side of the offset lacing system 110 or may simply envelop the boot. The ends of the cage arms can be configured to include an aperture that can fit over a corresponding lug (not shown). The lugs can be positioned along either or both sides of the gap formed in the upper 102 to accommodate the offset lacing system 110. The aperture may fit over the lug and remain in place due to frictional engagement. In another example, the cage 106 can be connected to the upper 102 via the lacing system 110. The lace 116 can be strung through the apertures 114 at the end of the cage arms to secure the cage support 106 in place. In yet another example, the cage support 106 may be held in place due to frictional engagement between the upper 102 and the cage support 106.

Figure 2:
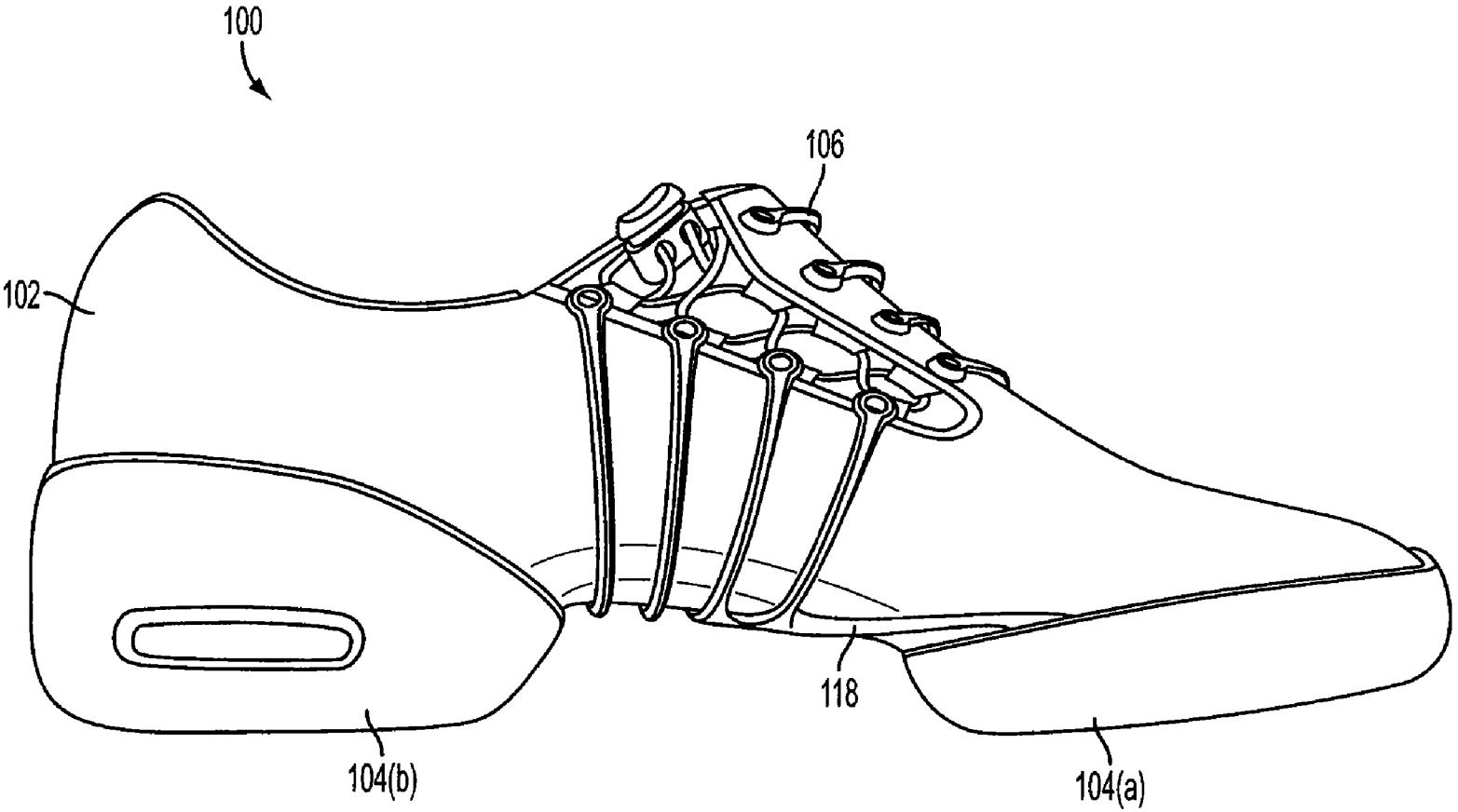
FIG. 2 is a lateral side view of the dance shoe of FIG. 1.
Figure 3:
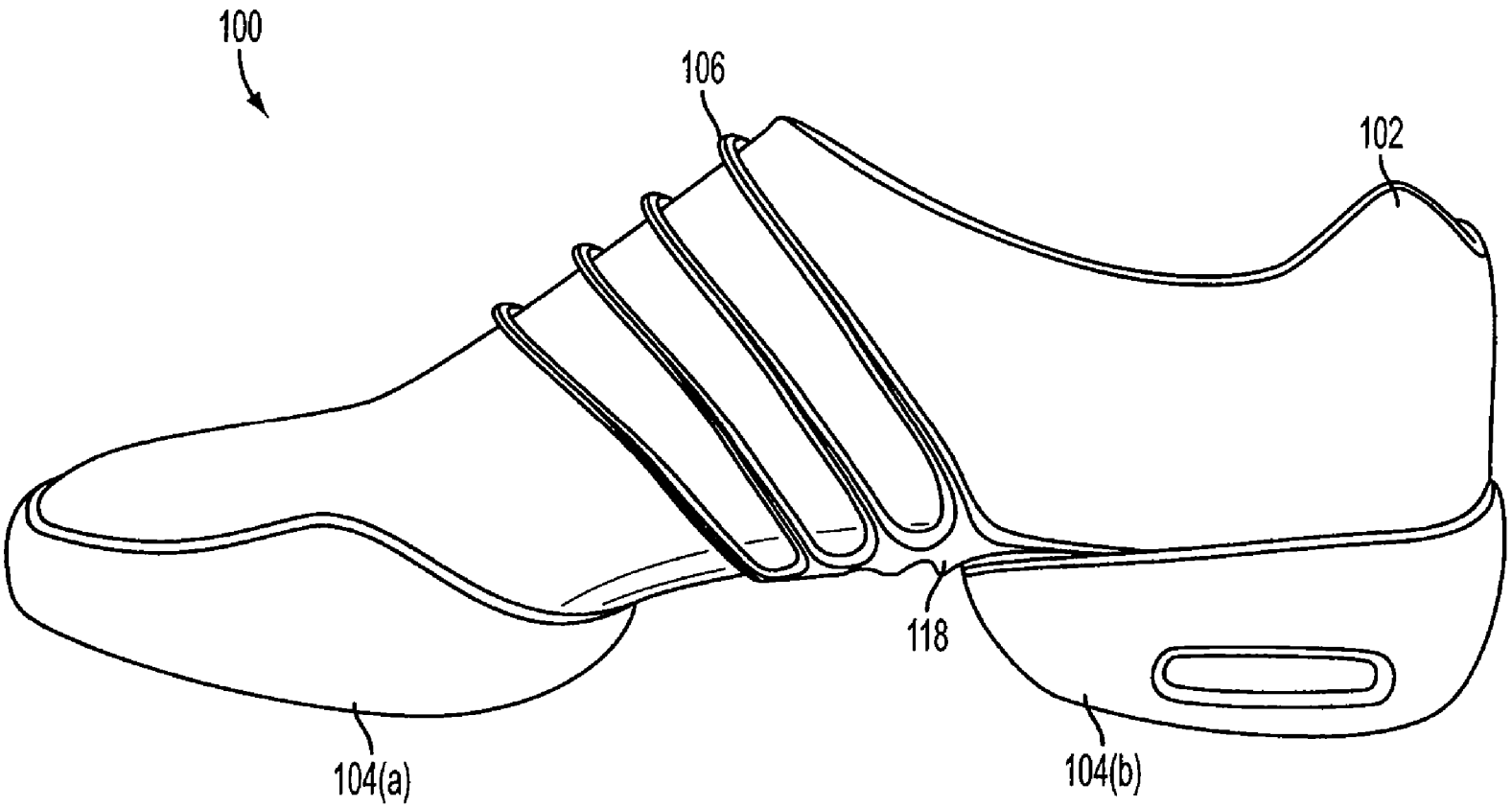
FIG. 3 is a medial side view of the dance shoe of FIG. 1.

FIG. 2 shows the shoe 100 of FIG. 1 as seen from the lateral side. The two-piece sole 104(*a*), 104(*b*) is clearly seen from this view. The front or toe portion 104(*a*) is connected to the upper 102 beneath the toe area of the user. The rear or heal portion 104(*b*) of the sole is attached to the upper 102 beneath the heel area of the user. The sole portions 104(*a*), 104(*b*) can include any suitable cushioning type. Suitable cushioning types include those known in the art such as a foam type cushioning system, bladder with tensile elements, fluid filled bladder in which the fluid is gas or liquid, foam puck type support (such as those marketed by NIKE, INC. under the trademark IMPAX), and the like.

The front and rear portions 104(*a*), 104(*b*) of the sole may each include different cushioning types. For instance, the rear sole portion 104(*b*) may include a bladder type cushioning system, while the front sole portion 104(*a*) may include a foam type cushioning system.

Figure 4:
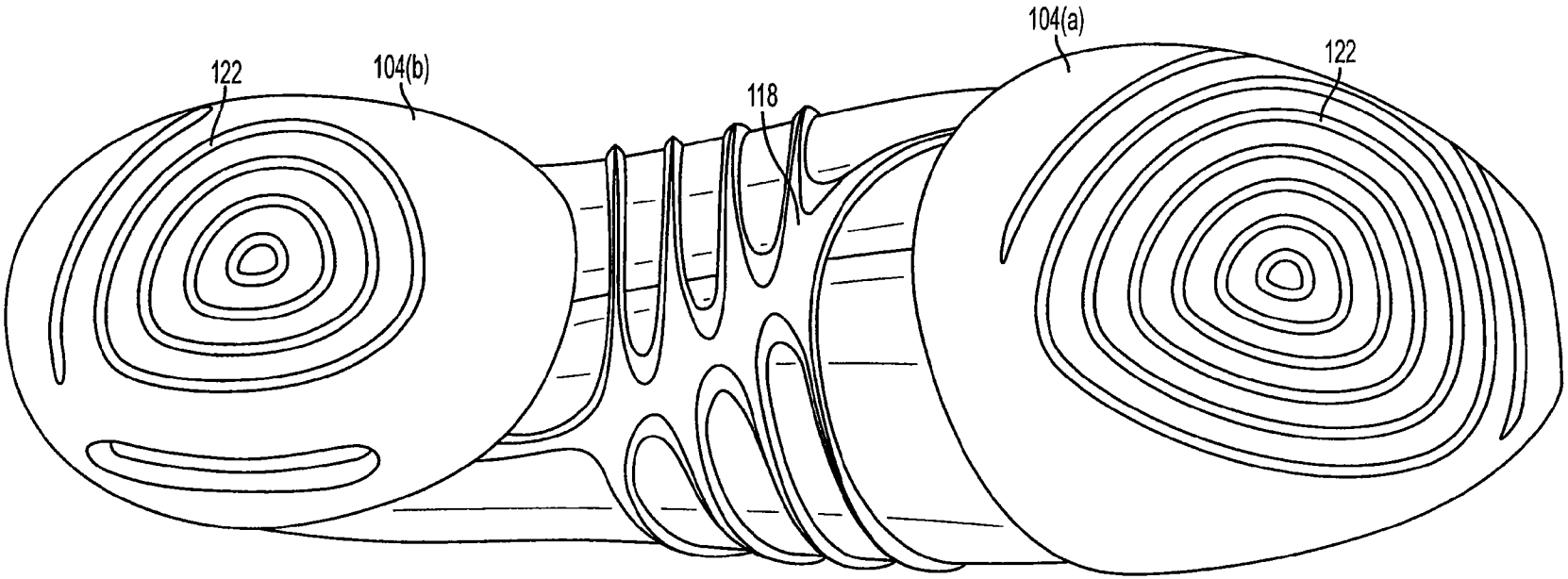
FIG. 4 is a bottom view of the dance shoe of FIG. 1 showing the support cage and separated outsole supports.

Further to FIG. 2, between each portion of the sole the cage support 106 is visible. The cage support 106 wraps around a portion of the upper 102 and includes a spine 118 that extends between the front 104(*a*) and rear 104(*b*) portions of the sole. As seen in FIG. 4, the spine 118 can be configured to sculpt the arch of the foot by extending from a point under the toe portion on one side of the centerline of the shoe 100 to a point under the heel portion on the opposite side of the centerline of the shoe 100. This offset configuration provides support for the arch of the foot when the foot is curled under, as when a dancer is doing pointe work. The forward portion of the spine 118 is visible in FIG. 2, while the rear portion of the spine 118 is visible in FIG. 3.

Figure 7:
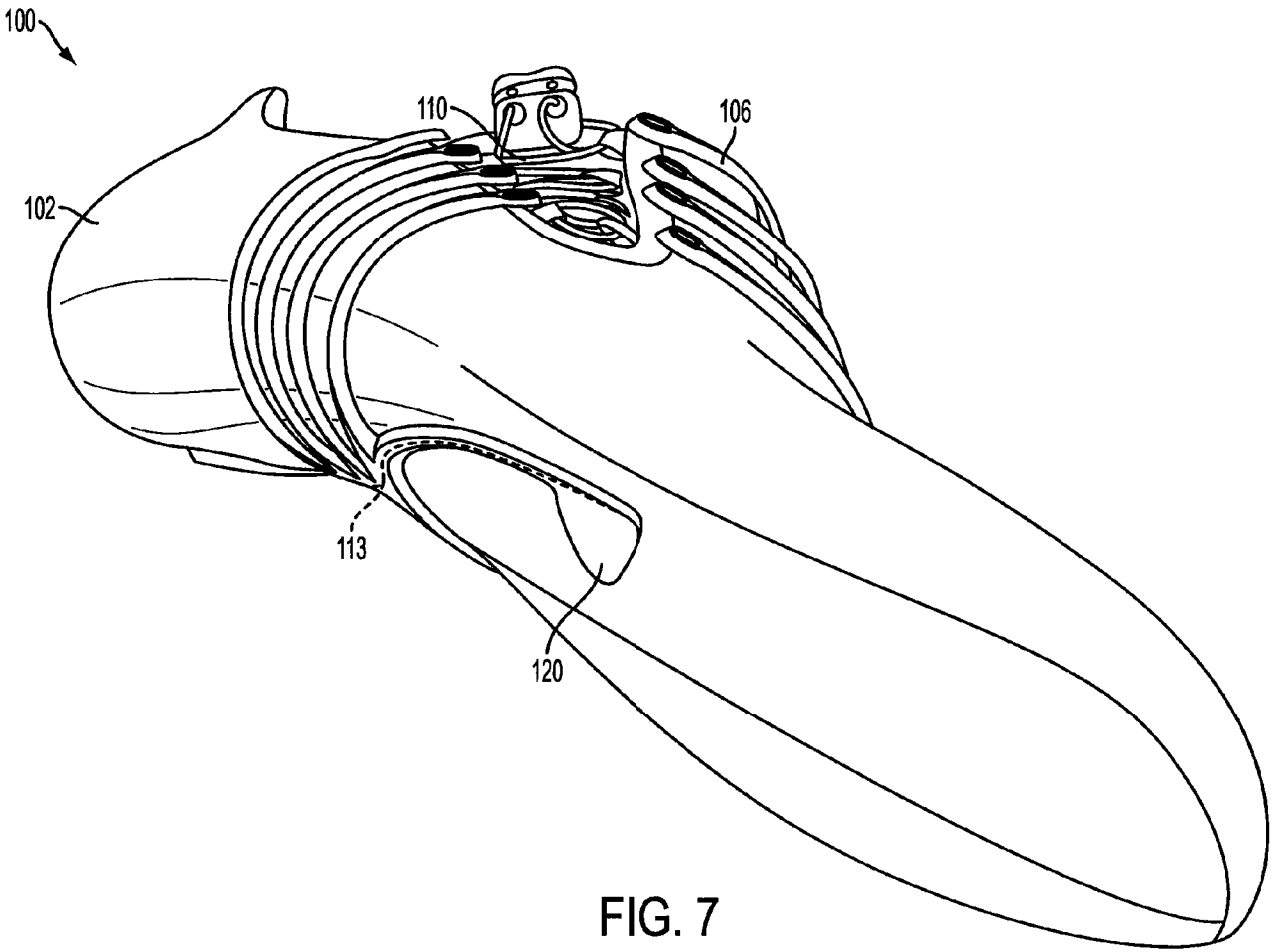
FIG. 7 is a lateral side perspective view of the dance shoe of FIG. 1 showing the offset support tabs of the support cage and the offset lacing system.

The cage support 106 further includes offset tabs 120, as seen in FIG. 6. Two offset tabs 120 are shown in FIG. 6 and are positioned at each end of the spine 118. Each tab 120 can be configured to point toward the centerline of the shoe 100 and the offset tabs 120 serve to further support the foot during moves involving flexing of the foot. In addition, the offset tabs 120 can aid in maintaining the line formed between the dancer's foot and leg. For example, when a dancer is doing pointe work, the foot is flexed around the arch region. The offset tabs 120 will aid in curling the foot inward, along pivot line 115 and resist twisting the foot along pivot line 117. In addition, strobel line 113 is shown in FIGS. 6 and 7. The strobel line 113 is s-shaped and may enhance the flexibility of the upper 102. In addition, the strobel line is generally encourages the upper to bend along the s-shape of the line. The strobel 113 can be a seam, a folded portion of material, a crease within the material, a weakened region, and the like. The strobel line 113 is generally covered by the spine 118 of the cage support 106.

FIG. 4 is a bottom view showing aspects of the dance shoe 100. The cage support 106 and spine 118 are shown extending from a front portion of the shoe 100 to a rear portion of the shoe 100. In addition, the two-piece sole 104(*a*), 104(*b*) is clearly visible. The front portion 104(*a*) of the sole can be connected to the upper 102 at the toe region and the rear portion 104(*b*) of the sole can be connected to the upper 102 at the heel region. With this two-piece configuration, there can be a clear break between each portion of the sole. The sole can be two separate pieces.

In addition, each portion 104(*a*), 104(*b*) of the two-piece sole can include a tread portion 122, configured on the bottom of each portion. The tread 122 may be configured in any one direction or in multiple directions. The tread portion 122 serves to provide traction to the dancer as the shoe 100 is in use. Alternatively, the sole can be a smooth surface, without grip, to allow for use of the shoe 100 with dance disciplines or moves that require little or no traction.

Figure 8:
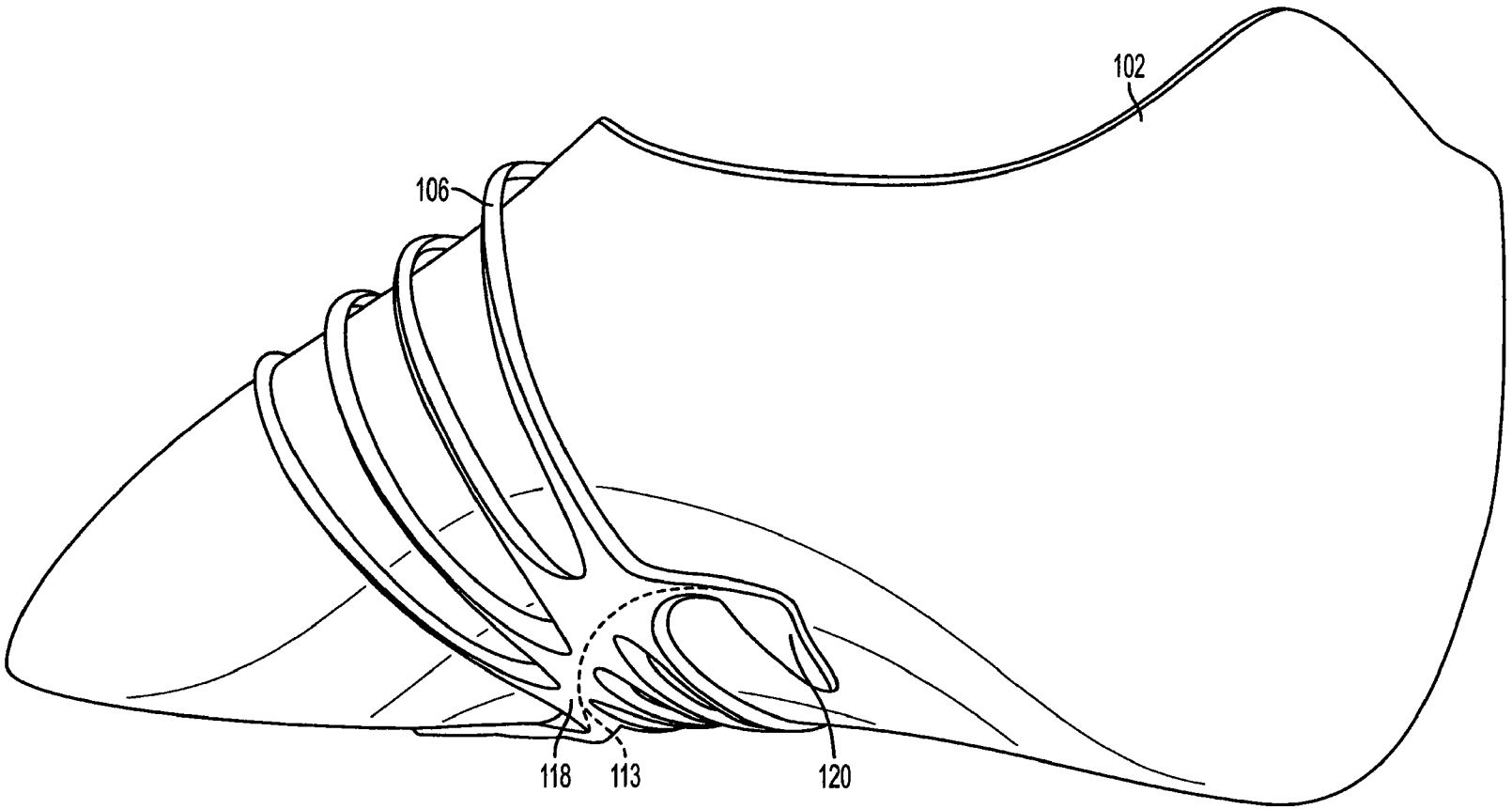
FIG. 8 is a medial side perspective view of the dance shoe of FIG. 1 showing the offset support tabs of the support cage.

FIGS. 7 and 8 are perspective views of the shoe 100 of FIG. 1. FIG. 7 shows a lateral side perspective view. The forward portion of the spine 118 and front support tab 120 are visible. In addition, the offset lacing system 110 and cage connection points can be seen. FIGS. 7 and 8 also show the strobel line 113, visible beneath the spine of the cage 106.

FIG. 8 is a medial side perspective view as seen from the back of the shoe 100. Again, the support cage 106 surrounds a portion of the upper 102 with the spine 118 positioned beneath the arch of the foot. The rear support tab 120 is also visible and serves to aid support of the foot during dance moves involving flexing the foot.

Figure 5:
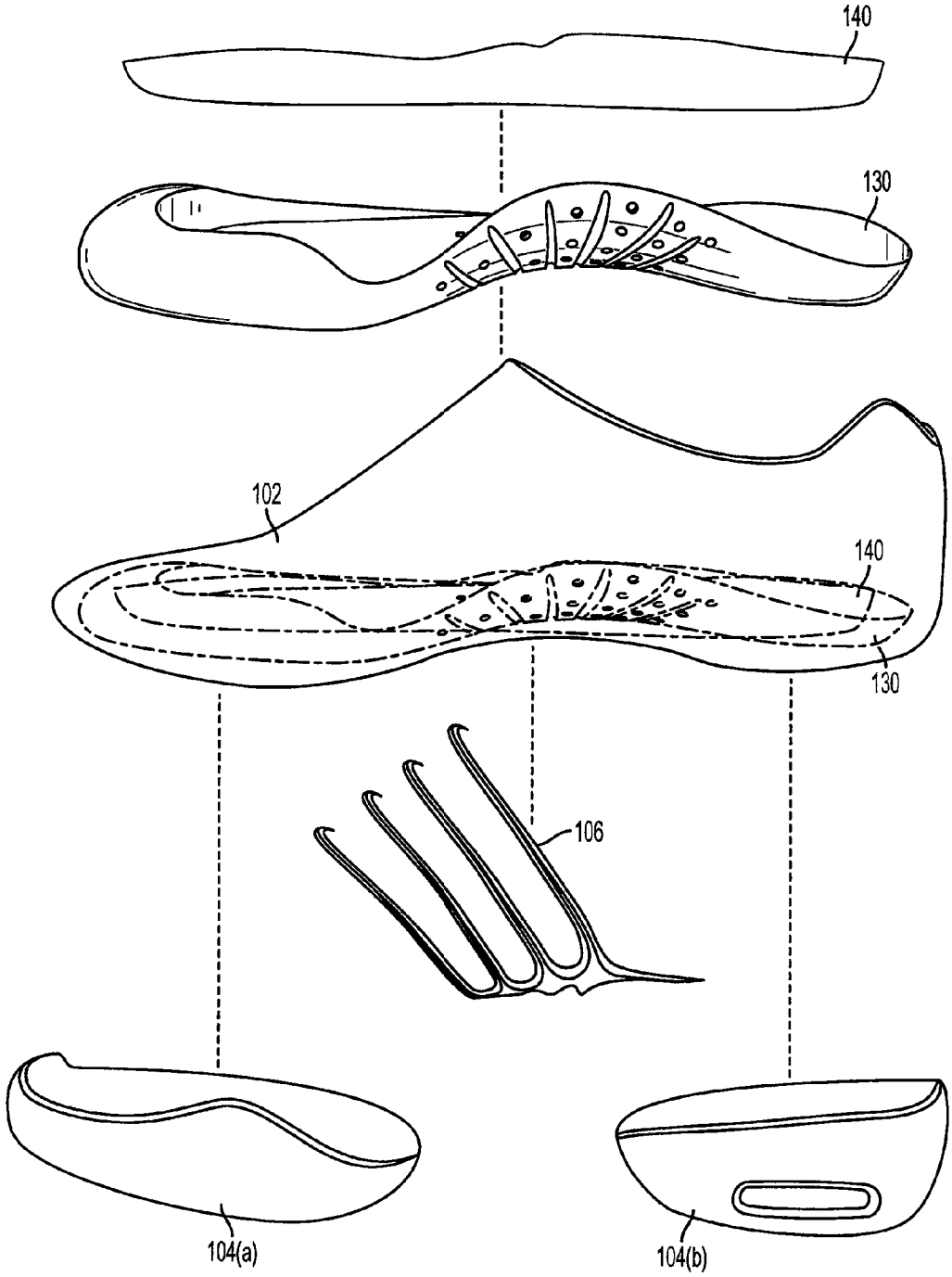
FIG. 5 is an exploded view of the dance shoe of FIG. 1.

FIG. 5 is an exploded view of the shoe 100 of FIG. 1. In addition to the elements described in association with FIG. 1, the shoe 100 of FIG. 5 can further include a liner 130 and a sock liner 140. The shoe 100 of FIG. 5 may be configured to include the liner 130 and/or the sock liner 140 but can also be configured for use without the liner 130 and/or sock liner 140.

FIG. 5 shows each portion of the two-piece sole 104(*a*), 104(*b*). As shown, the front portion of the sole 104(*a*) is beneath the toe portion of the upper 102. The rear portion 104(*b*) of the sole is beneath the heel portion of the upper 102. In addition, the cage support 106 is shown. The cage support 106 can wrap around a portion of the upper 102, surrounding the bottom portion of the upper 102 between each portion of the sole. The cage support 106 can wrap partially around the upper 102, leaving a gap (105 in FIG. 1) where the upper 102 is not supported by the cage support 106. This gap can include the lacing system (110 in FIG. 1) for the shoe 100.

The upper 102 of shoe 100 shown in FIG. 5 is shown with both the liner 130 and sock liner 140 inserted into the bottom of the upper 102. The liner 130 and sock liner 140 can be positioned on the bottom of the upper 102 with the liner 130 in contact with the inside surface of the bottom of the upper 102 and with the bottom surface of the upper 102 facing the inside surface of the bottom of the upper 102. The sock liner 140 can be positioned inside the upper 102 with the bottom surface of the sock liner 140 in contact with the top surface of the liner 130. Although the upper 102 is shown with both the liner 130 and sock liner 140 inserted, the shoe 100 could be configured to include the liner 130 alone or having neither the liner 130 nor sock liner 140 inserted.

Figure 9:
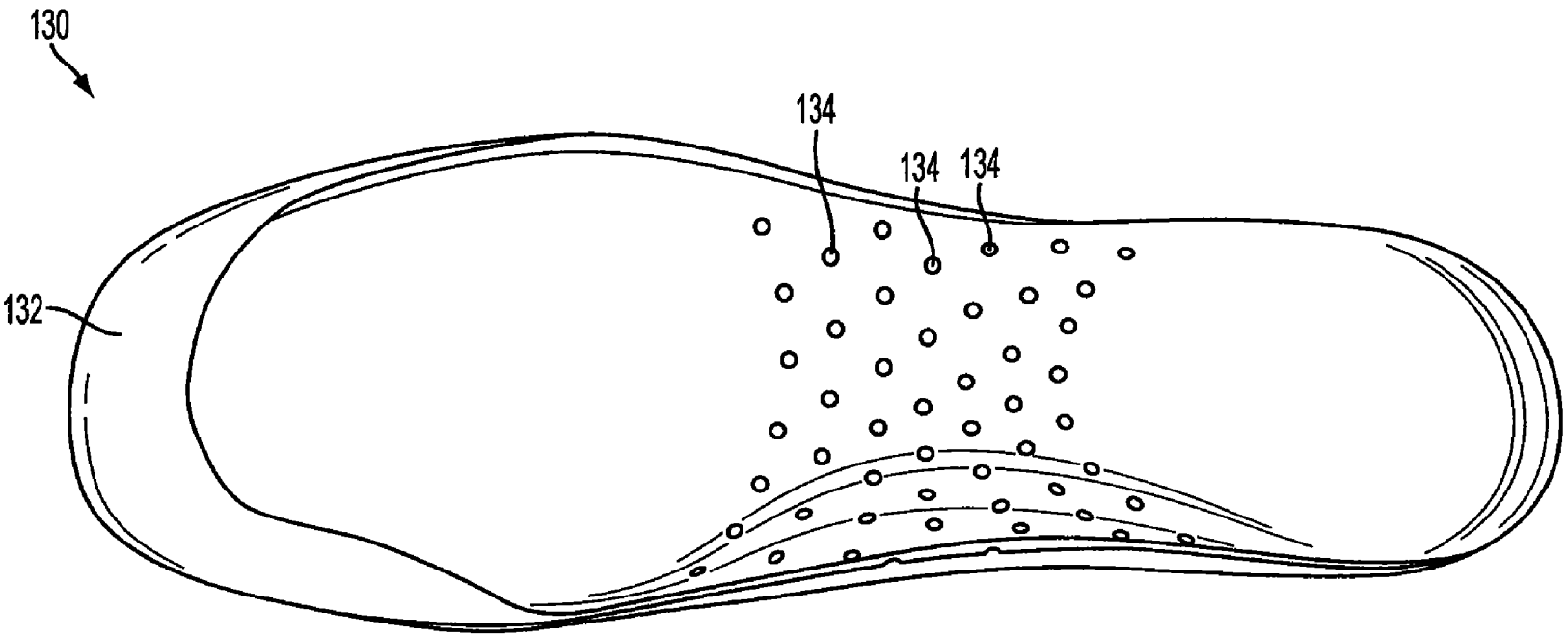
FIG. 9 is a top view of a liner of the dance shoe of FIG. 1 showing holes for breathability and an integrated toe box.

FIG. 9 is a top view of the liner 130 of FIG. 5. The liner 130 can have a front or toe portion and a rear, or heel portion. The front portion can include a toe box 132 that can support a dancer's foot when standing en pointe. The toe box 132 of the liner 130 can be integrated into the liner 130 itself, thereby removing the need to insert a separate toe box, as is often the case with conventional dance shoes.

The liner 130 of FIG. 9 also includes holes 134 or apertures formed in the liner 130. These holes 134 can be formed in the liner during construction and may extend from the top surface of the liner through to the bottom surface of the liner 130. The holes can provide ventilation and aid in breathability of the liner 130. The holes 134 allow air in to maintain the temperature of the foot and to keep the foot dry.

Figure 10:
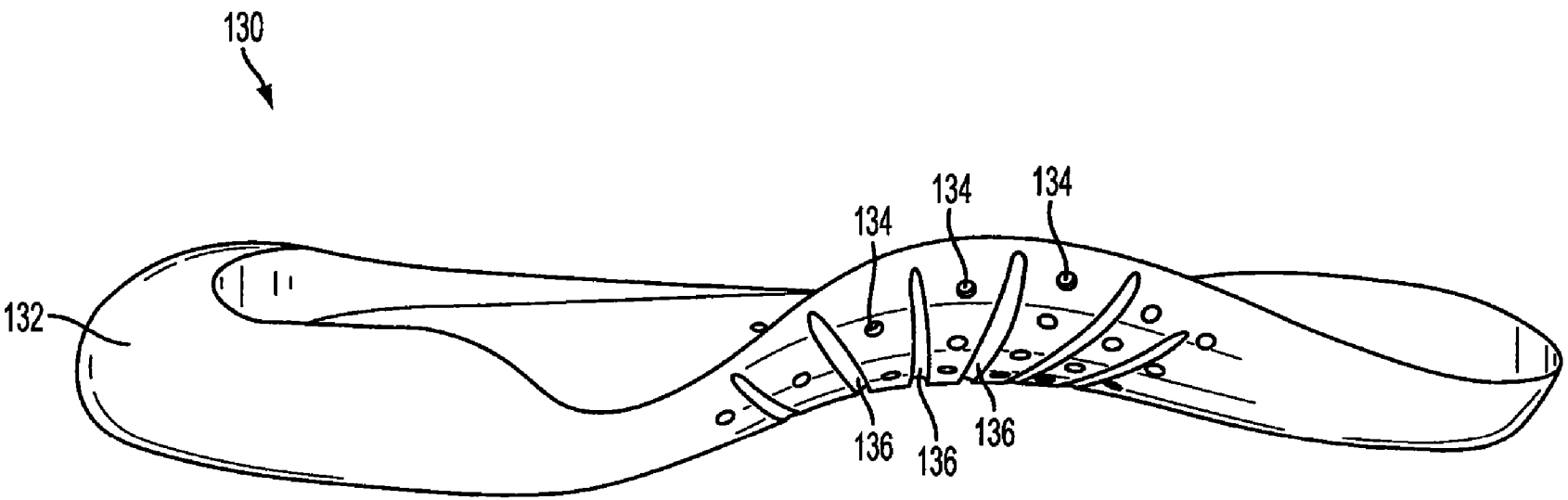
FIG. 10 is a medial side view of the liner of FIG. 9 showing the holes for breathability and flexible ribs.

FIG. 10 shows further aspects of the liner 130 of FIG. 9. The integrated toe box 132 is seen at the front portion of the liner 130. Also, the underside of the holes 134 seen on the top of the liner 130, are visible in FIG. 10.

The integrated toe box 132 can provide support for the foot of a dancer doing pointe work without the inconvenience of having to insert a separate toe box into the shoe. In addition, the one piece liner 130 with the integrated toe box 132 can provide for a smooth appearance of the shoe 100. For example, the one piece construction provides a smooth exterior surface without any potential flaws in the line of the foot due to the toe box being out of position. This smooth line of the foot is enhanced by the offset lacing system 110 since the lacing system 110 is then somewhat hidden and does not detract from the line formed between the foot and leg of the dance in some movements.

Further to FIG. 10, a plurality of ribs 136 is shown on the bottom of the liner 130. These ribs 136 can be formed into the liner during construction of the liner and can be grooves located throughout the arch area of the foot. The ribs can provide additional flexibility to the liner 130. For instance, when a dancer stands en pointe, the foot is arched. The ribs 136 allow the liner 130 to arch with the foot to maintain the line of the foot and leg that is desired in such a position.

Figure 11:
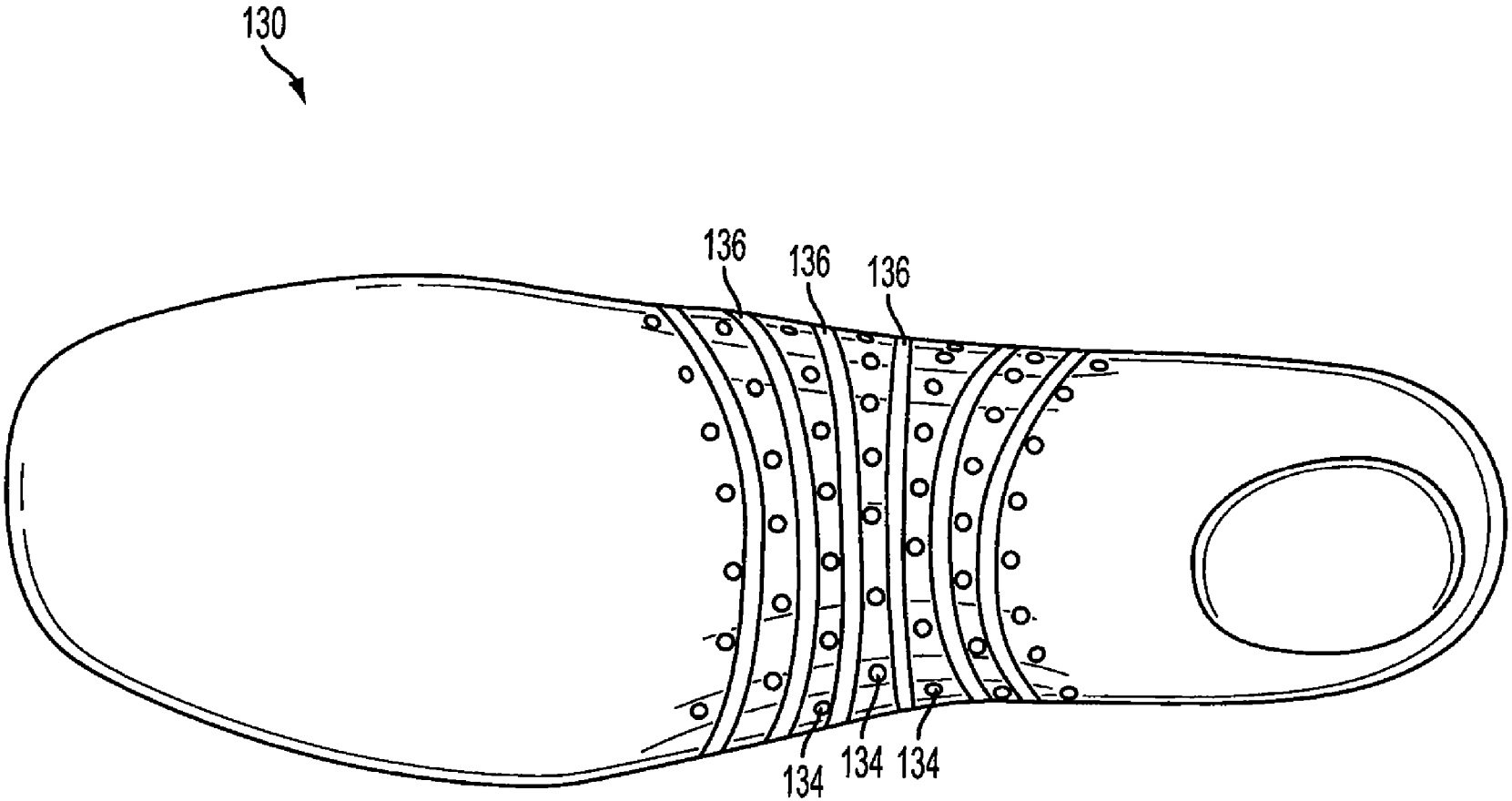
FIG. 11 is a bottom view of the dance shoe liner of FIG. 9 including the holes for breathability and flexible ribs.

FIG. 11 shows the bottom of the liner 130 and more clearly shows the ribs 136 and holes 134 described in FIGS. 9 and 10. The plurality of holes 134 and ribs 136 can be positioned throughout the arch area of the liner 130. Both the holes 134 and ribs 136 can extend from the lateral side to the medial side of the liner 130 to aid in flexibility.

Figure 12:
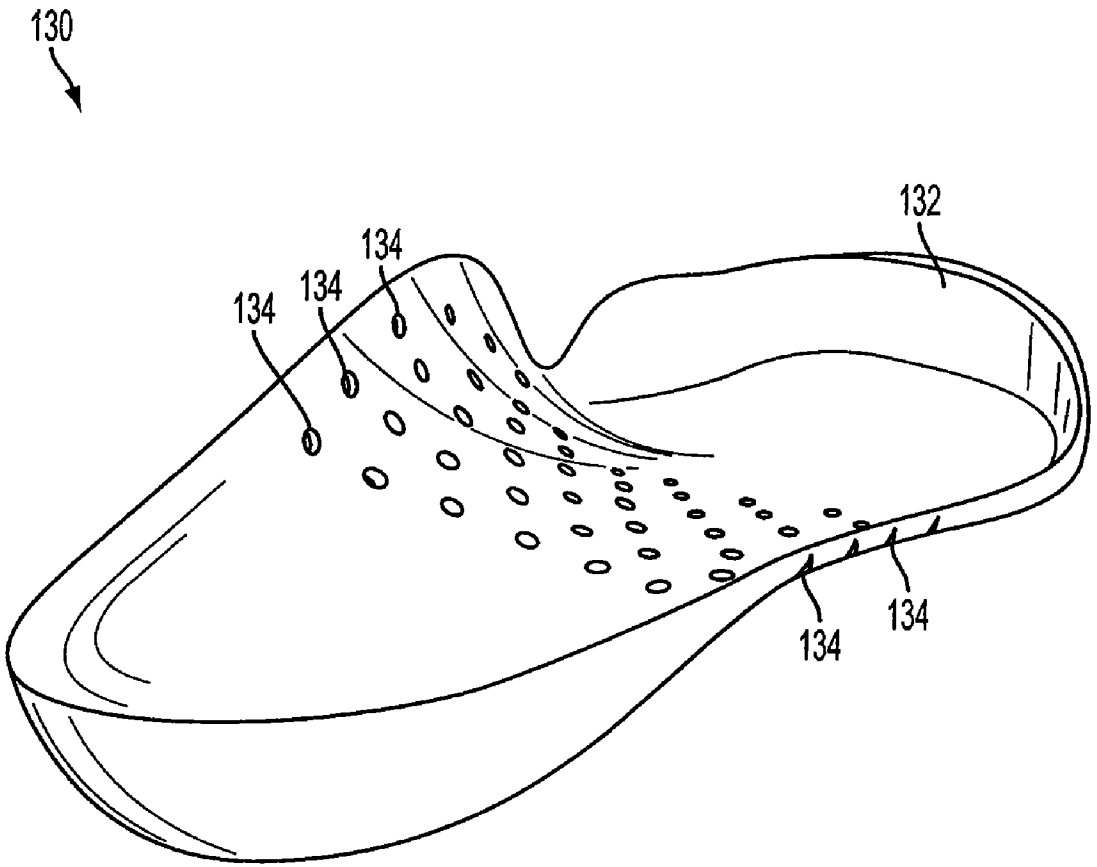
FIG. 12 is a rear perspective view of the lateral side of the dance shoe liner of FIG. 9.
Figure 13:
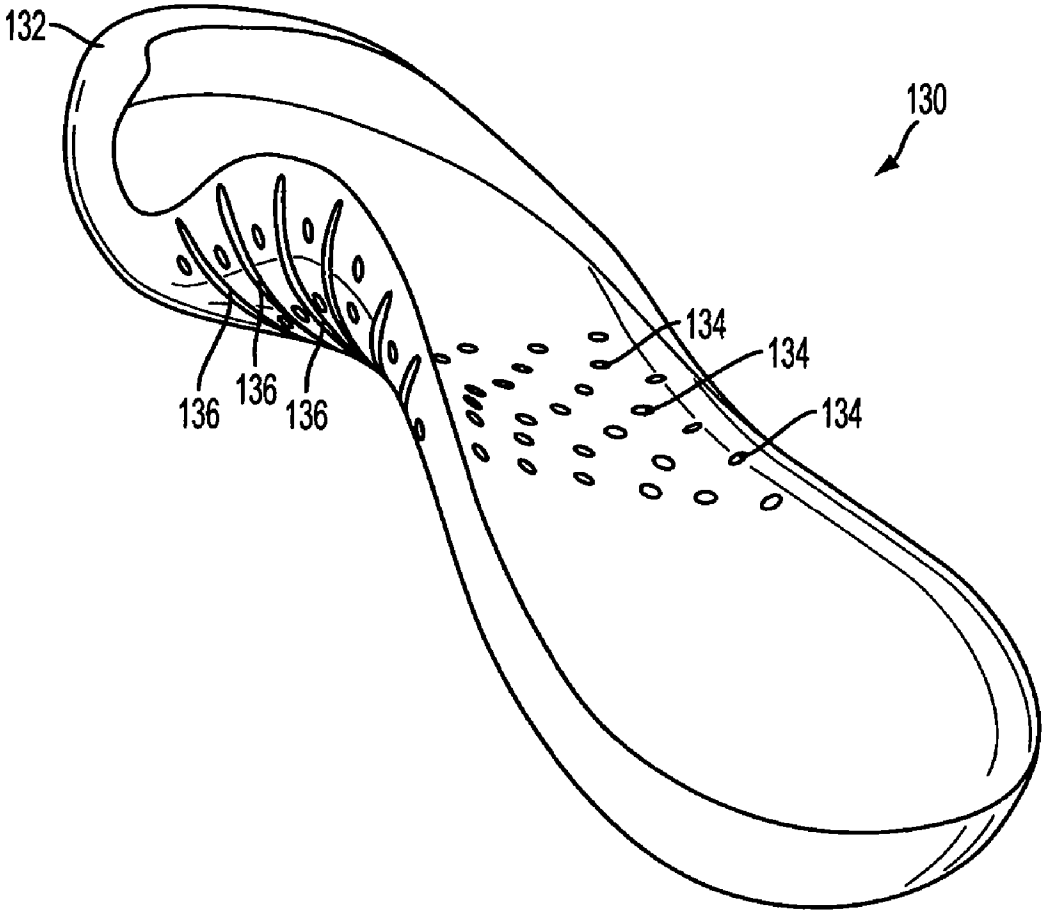
FIG. 13 is a rear perspective view of the medial side of the dance shoe liner of FIG. 9.

FIGS. 12 and 13 show the liner 130 from varying rear perspective views. In each figure, the integrated toe box 132 is visible at the front of the liner 130. The varying perspective views also show the plurality of holes 134 distributed throughout the arch region and the flexible ribs 136.

Figure 14:
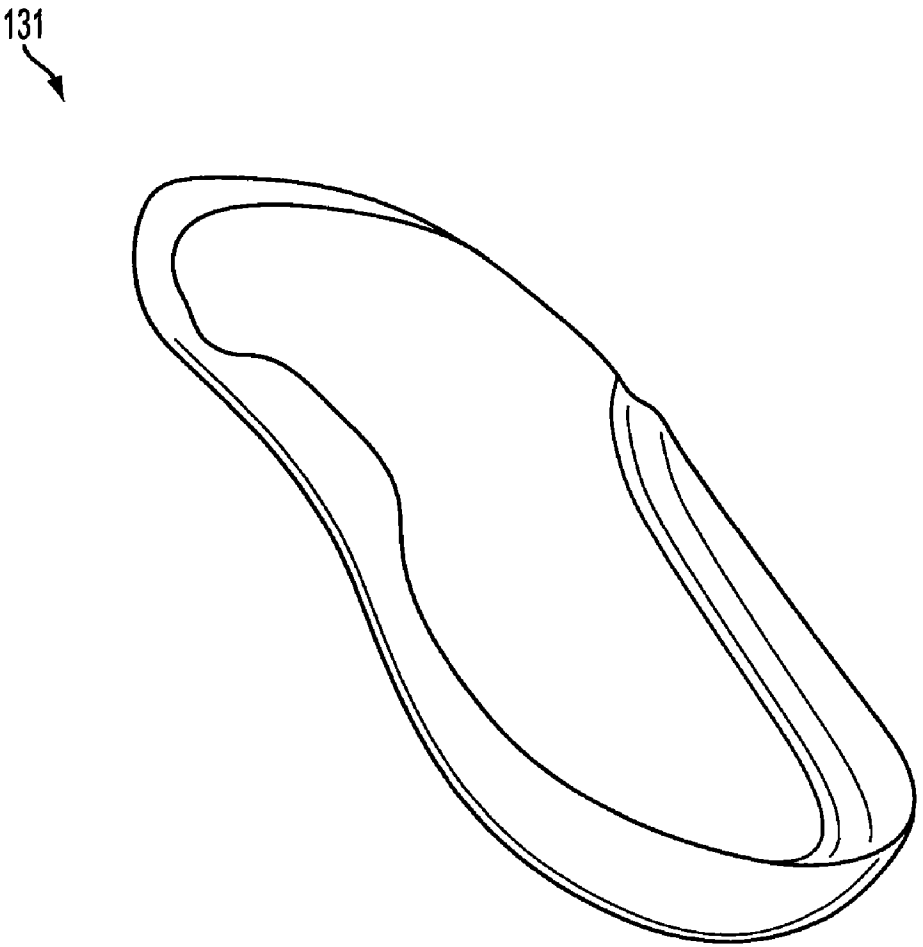
FIG. 14 is a perspective view of a another arrangement of a liner that may be part of the dance shoe of FIG. 1.
Figure 15:
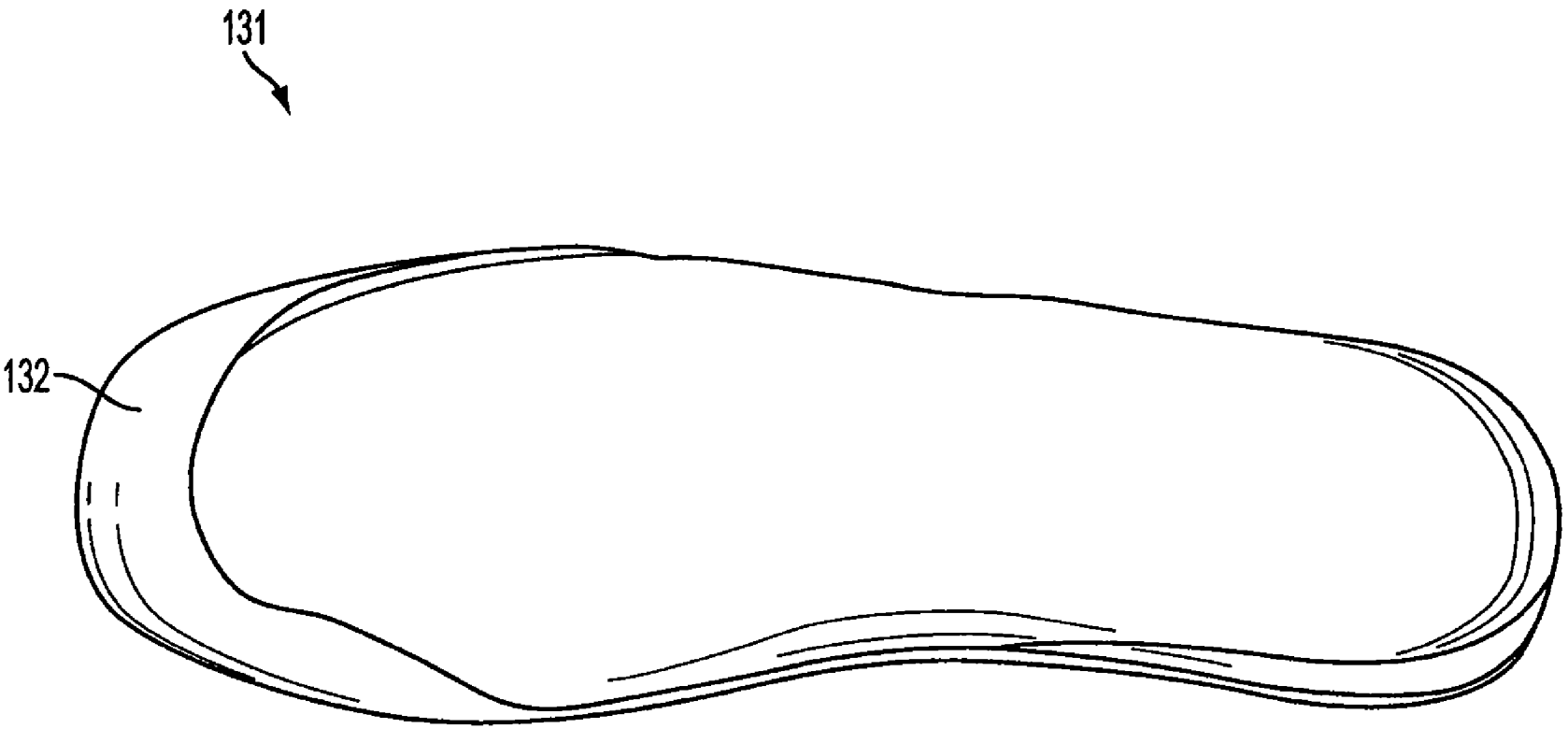
FIG. 15 is a top view of the liner of FIG. 14 without holes for breathability.

FIGS. 14 and 15 show another configuration of a liner. The liner 131 of this arrangement can include an integrated toe box 132. In addition, the liner is seen without ventilation holes. The liner 131 may include ribs (not shown) to provide additional flexibility for the liner 131.

Figure 16:
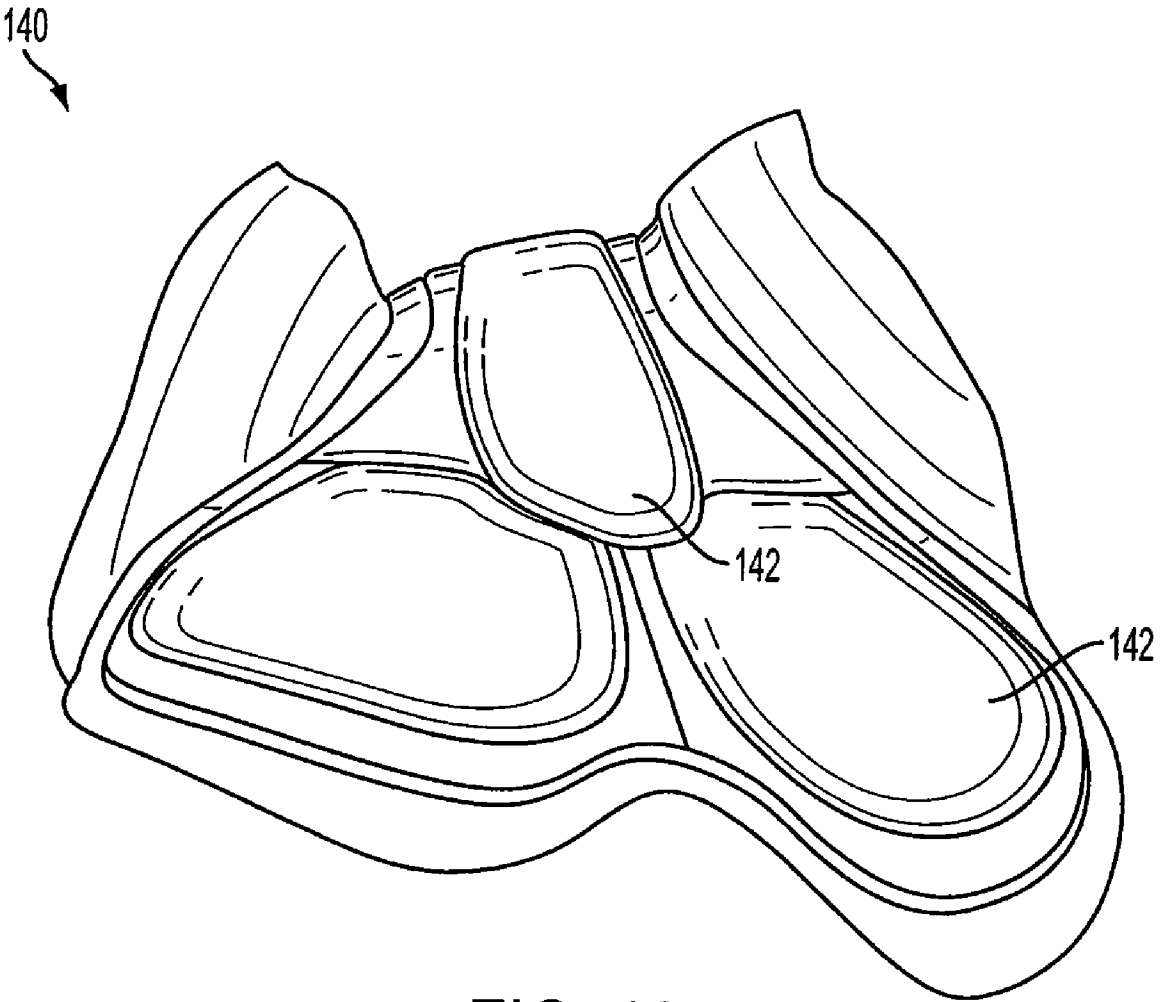
FIG. 16 is a front view of a sock liner with additional padding that may be part of the dance shoe of FIG. 1.

FIG. 16 is a sock liner 140 that can also be included in shoe 100. The sock liner 140 can be positioned inside the upper 102 and on top of the liner 130. For instance, the bottom side of the sock liner 140 can be in contact with the top side of the liner 130. In addition, the sock liner 140 can include additional padding 142 in the front or toe area. This additional padding 142, as seen in FIG. 16, can be arranged throughout the toe area to add additional cushioning beneath the toes and the ball of the foot. The padding 142 can be additional pieces of cushioned material connected to the sock liner 140. In another arrangement, the cushioned pads 142 may be an integrated part of the liner surface.

Figure 17:
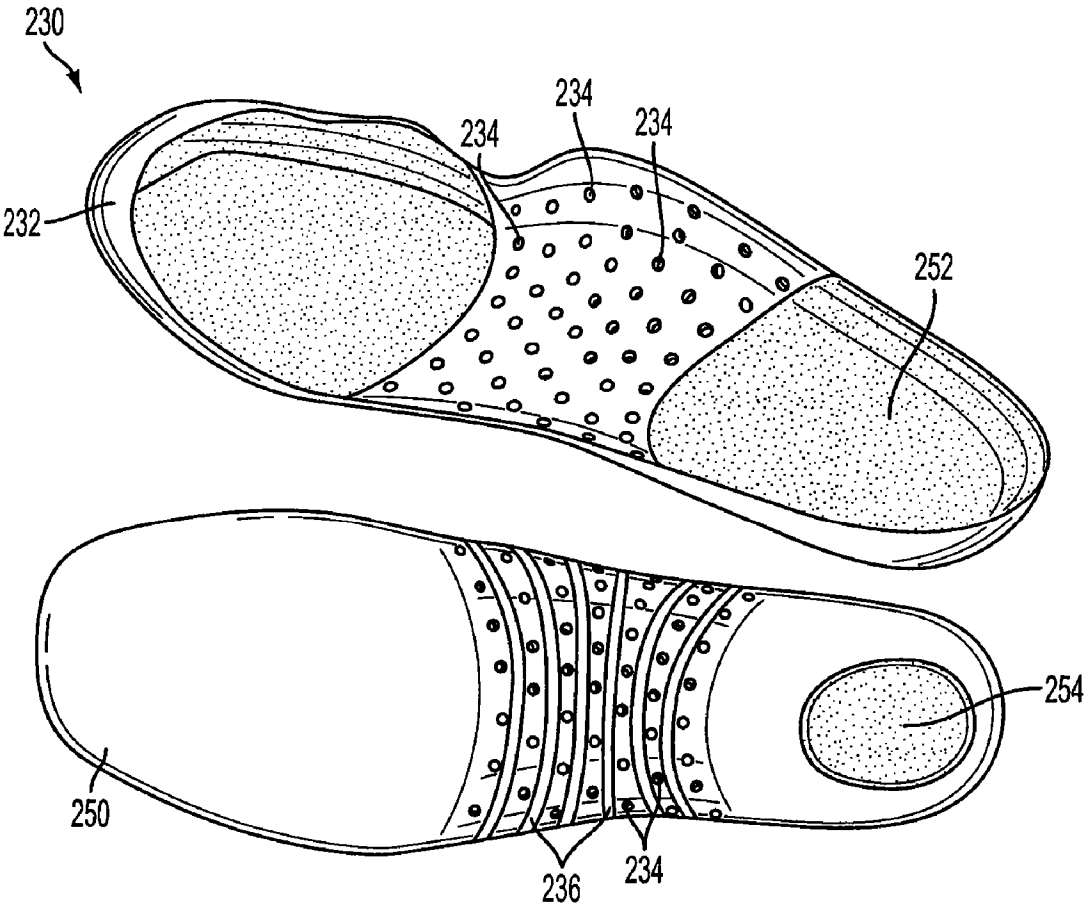
FIG. 17 is another configuration of the liner of FIG. 9 with two materials used in the liner.

FIG. 17 shows another arrangement of the liner 230 of FIG. 9. The plurality of holes 234 and ribs 236 are seen in the liner of FIG. 17. In addition, although the liner 230 is one piece, it can be formed of two different materials. For example, much of the bottom surface 250 of the liner 230 can be formed of one material, while the top surface 252 can be formed of another. For instance, the bottom surface 250 can be a relatively rigid material to support the foot during various dance moves. The top surface 252, and a portion of the bottom surface 254 in some configurations, can be formed of a relatively resilient or shock absorbing material to add comfort to the shoe. This liner 230 may be, preferably, formed of a two-shot molding process or can be formed via a combination of two processes.

Figure 18:
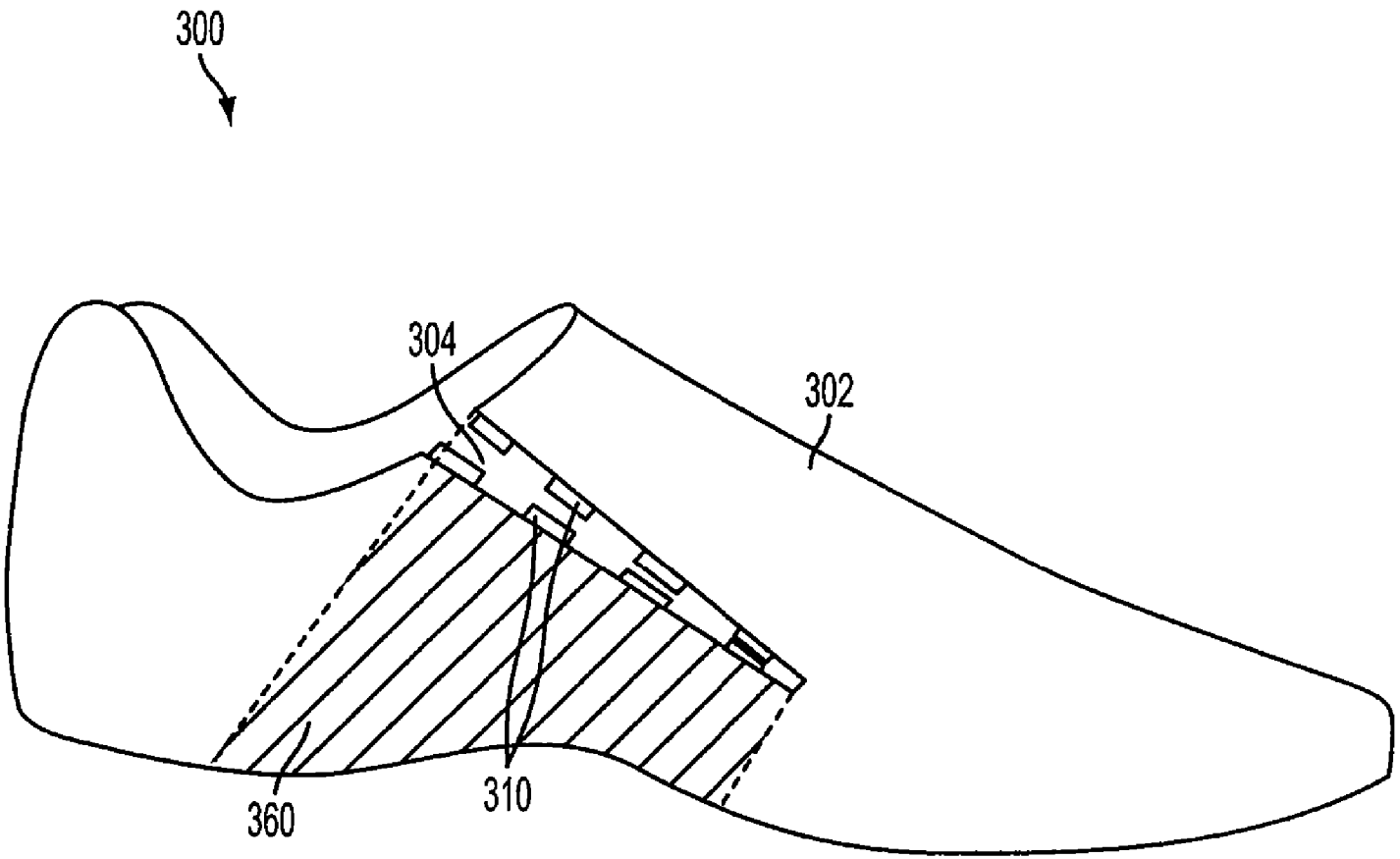
FIG. 18 is another embodiment of the dance shoe of FIG. 1 with a boot forming a gap for an offset lacing system and having an elastic skin.
Figure 19:
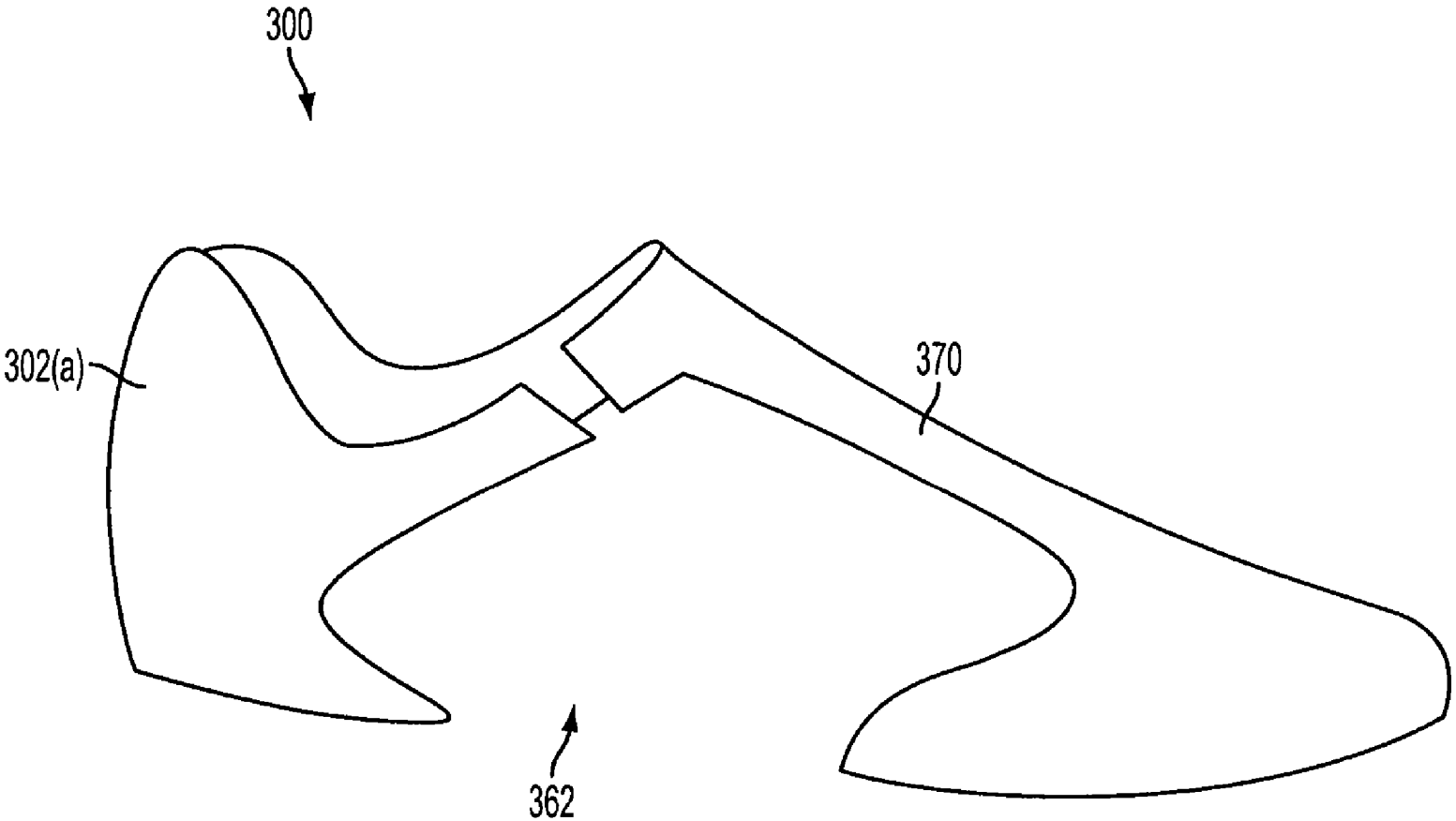
FIG. 19 is the boot portion of the dance shoe of FIG. 18.

FIGS. 18 and 19 depict another arrangement of the dance shoe 300, which can include various aspects and features discussed along with FIGS. 1-17 in various combinations. The dance shoe of this arrangement includes a structural boot or upper 302. The upper 302 can be slipper-like and provide a snug fit to the foot of the dancer. As seen in FIG. 18, the exterior portion of the upper 302 can be formed of a light-weight material that allows for minimal stretch. The material chosen can also be breathable.

Further to FIGS. 18 and 19, the upper 302 of the dance shoe includes a gap 304 to accommodate a lacing system 310 or other type of closure. For example, the lacing system 310 may be conventional eyelets or loops to hold a standard lace. In another configuration, the closure system 310 can include a series of hook and eye closures. The gap 304 can be offset from the center to prevent the lacing system 310 from interfering with the line of the arch during various dance movements. The offset lacing system 310 can also allow the lacing to be relatively hidden. In addition, the lacing system 310 can include an elastic lace, secured by a toggle, to provide for relatively quick changes of the shoe.

The dance shoe 300 can also include an elastic skin 360 or wrap that is secured to the bottom of the shoe 300 on the interior of the upper 302. The wrap 360 can be made of any suitable material with elastic properties that will allow the wrap 360 the stretch to accommodate a foot when it is being inserted. In one example, the wrap 360 can be formed of NEOPRENE®. The wrap 360 can act as a tongue beneath the offset lacing system 310. For instance, the wrap 360 may protect the foot from contact with the lace or other fastener used in the closure system 310.

The interior of the upper 302 can include a boot 302(*a*), shown in FIG. 19, nested within the upper (not shown) that is tight-fitting to the foot. The interior boot 302(*a*) can be made of skin-like materials, such as suede or chamois. The interior boot 302(*a*) can include a t-strap 370 that extends from the toe area to the ankle area, along the top of the foot. The interior boot 302(*a*) can include an open area 362 surrounding the arch of the foot. This open area 362 allows the foot to curl around the arch without interference from the interior boot 302(*a*).

The dance shoe has been described in terms of preferred and exemplary arrangements thereof. Numerous other arrangements, modifications and variations within the scope and spirit of the appended claims will occur to persons of ordinary skill in the art from a review of this disclosure.

What is claimed is:

1. A dance shoe, comprising:

an upper forming a gap on a middle side portion of the upper;

a closure system contained within the gap; and an elastic skin positioned within the upper and connected to a bottom of the upper, the elastic skin extending beneath the closure system and in contact with the closure system to protect a foot of a wearer from the closure system.

2. The dance shoe of claim 1, wherein the closure system includes apertures and a shoe lace extending through the apertures.

3. The dance shoe of claim 2, wherein the shoe lace is an elastic drawcord fastened by a slide closure.

4. The dance shoe of claim 1, further comprising two separate outsole supports.

5. The dance shoe of claim 1, further comprising an interior boot nested within the upper, having an open area to allow for flexibility.

6. The dance shoe of claim 5, wherein the interior boot is flexible and configured to fit the foot as a skin.

7. The dance shoe of claim 5, wherein the interior boot is made of a material allowing minimal stretch.

8. A dance shoe, comprising:

an upper defining a void for receiving a foot of a wearer, the upper including an interior boot portion and a gap formed in the upper, the gap being offset from a center of the upper;

a closure system contained within the gap and configured to secure the dance shoe to the foot of the wearer; and an elastic skin configured to extend around at least a portion of the foot of the wearer and positioned on an interior of the upper, the elastic skin being positioned beneath the closure system and in contact with the closure system to protect the foot of the wearer from the closure system.

9. The dance shoe of claim 8, wherein the elastic skin is connected to a bottom surface of the interior of the upper.

10. The dance shoe of claim 8, wherein the interior boot portion includes an open area around an arch area of the foot.

11. The dance shoe of claim 10, wherein the open area is configured to allow bending of the foot in the arch area.

12. The dance shoe of claim 8, wherein the closure system includes a plurality of eyelets and a lace.

13. The dance shoe of claim 12, wherein the lace is an elastic cord.

14. An upper for a dance shoe, comprising:

an exterior upper portion having a closure system for the dance shoe;

an interior boot portion nested within the exterior upper portion and configured to fit tightly to a foot of a wearer, the interior boot portion having an open area corresponding to an arch area of the foot of the wearer; and an elastic band extending around at least a portion of the foot of the wearer, the elastic band extending beneath the closure system and in contact with the closure system of the dance shoe to protect the foot of the wearer from the closure system.

15. The upper for a dance shoe of claim 14, wherein the interior boot portion is formed of at least one of suede or chamois.

16. The upper for a dance shoe of claim 14, further including a gap formed in the upper, the gap being offset from a center of the upper.

17. The upper for a dance shoe of claim 16, wherein the closure system is contained within the gap.

18. The upper for a dance shoe of claim 17, wherein the closure system further includes a plurality of eyelets and a lace.

19. The upper for a dance shoe of claim 18, wherein the lace is an elastic cord.

20. The upper for a dance shoe of claim 14, wherein the upper area of the interior boot portion is configured to permit bending of the foot in the arch area.

* * * * *